US012421715B1

(12) United States Patent
Lesin et al.

(10) Patent No.: US 12,421,715 B1
(45) Date of Patent: Sep. 23, 2025

(54) METHOD OF POSITIONING BUILDING ELEMENTS

(71) Applicant: ADDRESS ROBOTICS LIMITED, UK, London (GB)

(72) Inventors: Leonid Lesin, Belgrade (RS); Viktor Smorygo, Belgrade (RS); Pavel Rudenko, Belgrade (RS); Rodion Shishkov, London (GB)

(73) Assignee: ADDRESS ROBOTICS LIMITED, UK, London (GB)

( * ) Notice: Subject to any disclaimer, the term of this patent is extended or adjusted under 35 U.S.C. 154(b) by 0 days.

(21) Appl. No.: 18/987,702

(22) Filed: Dec. 19, 2024

(51) Int. Cl.
*E04B 1/348* (2006.01)
*E04B 1/35* (2006.01)

(52) U.S. Cl.
CPC ..... *E04B 1/35* (2013.01)

(58) Field of Classification Search
CPC ..... E04B 1/3483; E04B 1/2403; E04B 2001/3583; E04B 2001/246; E04C 2/46; E04C 2/12
See application file for complete search history.

(56) References Cited

U.S. PATENT DOCUMENTS 3,824,750 A * 7/1974 Antoniou ..... E04B 1/3483 52/223.4
5,906,084 A * 5/1999 Millington ..... E01D 19/125 52/263
6,625,937 B1 * 9/2003 Parker ..... E04H 1/02 52/79.9
7,594,361 B2 * 9/2009 Tragant Ruano ... E04B 1/34823 220/4.27
10,357,896 B2 * 7/2019 Lewis ..... B32B 7/04
10,807,835 B2 * 10/2020 Klapper ..... F16C 13/006
11,118,348 B2 * 9/2021 Strickland ..... E04B 2/88
11,365,539 B2 * 6/2022 Meney ..... E04B 1/2403
2015/0030387 A1 * 1/2015 Poustchi ..... E04B 2/825 403/361
2020/0181905 A1 * 6/2020 Jarck ..... E04C 2/46
2022/0259858 A1 * 8/2022 Espinosa ..... E04B 1/10

OTHER PUBLICATIONS

Unipunch Web Page of Material Specifications (Year: 2021).*

* cited by examiner

*Primary Examiner* — Brian E Glessner
*Assistant Examiner* — Daniel J Kenny
(74) *Attorney, Agent, or Firm* — ASLAN LAW, P.C.

(57) ABSTRACT

The invention relates to the field of construction, in particular to the assembly of buildings or structures from prefabricated modular building elements, for example wooden panels.

A method for positioning building elements, comprising the following steps: lifting a building element; moving the building element in a suspended state to a position as close as possible to the design position; lowering the building element onto a foundation; wherein the elastic deformation of the building element and the foundation is within a specified range; wherein leading positioning elements are arranged on the lower part of the building element; wherein corresponding positioning elements are installed into the upper surface of the foundation; and wherein the building element is lowered onto the foundation until its positioning elements come into contact with the foundation's positioning elements, after which the building element is allowed to bear its own weight again.

4 Claims, 3 Drawing Sheets

METHOD OF POSITIONING BUILDING ELEMENTS

FIELD OF TECHNOLOGY

The invention relates to the field of construction, in particular to the assembly of buildings or structures from prefabricated modular building elements or prefabricated building components, for example, wooden panels.

DESCRIPTION OF RELATED ART

Existing methods for positioning building elements, i.e., correctly locating elements in space and bringing them into their design positions, involve the use of manual labor. Typically, a building element is placed in a position close to its design location using cranes or other lifting devices. On the construction site, a building element, for example a CLT (Cross-Laminated Timber) or GLT (Glued Laminated Timber) panel, is lifted and spatially oriented using slings, and then lowered onto a prepared supporting surface. After that, the panel's final position is adjusted manually using hand tools and measuring instruments.

Known methods for positioning building elements are characterized by the following disadvantages: the labor-intensive and complex process of positioning prefabricated elements; accumulation of geometric errors and the need for correction; a high risk of human error; and stringent requirements for the manufacturing quality of the elements. The claimed method eliminates these drawbacks.

BRIEF SUMMARY OF THE INVENTION

A method for positioning building elements, comprising the following steps: lifting a building element; moving the building element in a suspended state to a position as close as possible to the design position; lowering the building element onto a foundation; wherein the elastic modulus of the building element is in a range of 5000 to 20000 MPa; wherein the elastic modulus of the foundation is in a range of 5000 to 20000 MPa; wherein positioning elements are placed on the lower part of the building element; wherein corresponding positioning elements are placed on the upper surface of the foundation; and wherein the building element is lowered onto the foundation until its positioning elements come into contact with the foundation's positioning elements, after which the building element is allowed to bear its own weight again.

A method for positioning building elements, comprising the following steps: lifting a building element; moving the building element in a suspended state to a position as close as possible to the design position; lowering the building element onto a foundation; wherein leading positioning parts are placed on the lower part of the building element; wherein corresponding positioning parts are installed into the upper part of the foundation; wherein the building element is lowered onto the foundation until its positioning elements come into contact with the foundation's positioning elements, after which the building element is allowed to bear its own weight again; and wherein the following parameters are selected so as to satisfy a specific inequality: Young's modulus of the building element material (E1), cross-sectional area of the building element material (S1), Young's modulus of the foundation material (E2), cross-sectional area of the foundation material (S2), shear strength of the positioner material (τ), shear area of the positioners (A), distance between the axes of the positioning elements (L), and the maximum misalignment error in the leading and corresponding positioning elements, taking into account clearances (Δ), are chosen such that the inequality is satisfied:

$$E1 \times E2 < (\tau \times A \times L \times (E1 \times S1 + E2 \times S2)/(\Delta \times S1 \times S2).$$

In some embodiments, the surface hardness of the positioning elements is in the range of 45-50 HRC (Rockwell hardness scale C).

In some embodiments, the shear strength of the positioning elements is at least 300 MPa.

In some embodiments, the leading positioning element is shaped like a cone, and the taper angle of the leading positioning element is in the range of 20-30°.

DETAILED DESCRIPTION OF THE INVENTION

Figure 1:
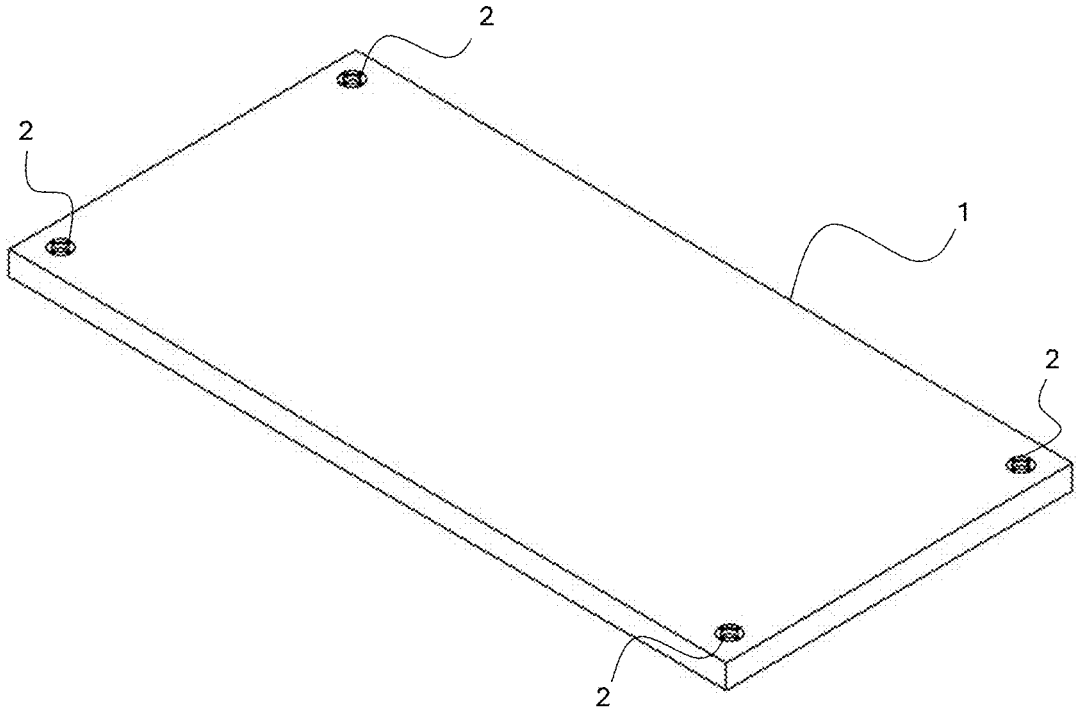
FIG. 1 shows the foundation (1) with corresponding positioning parts (2).
Figure 2:
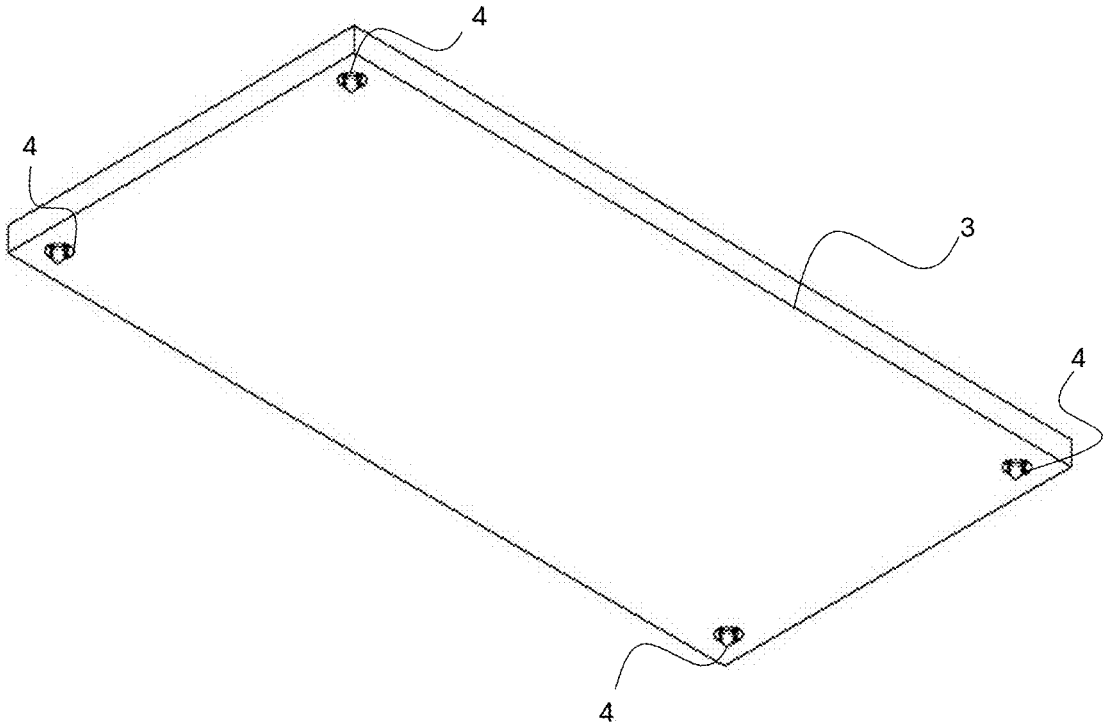
FIG. 2 shows the building element (3) with leading positioning parts (4).
Figure 3:
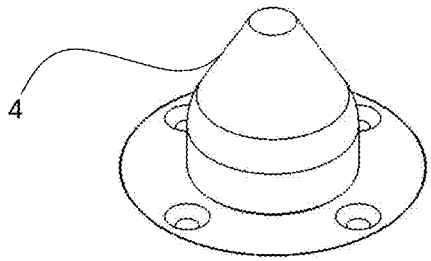
FIG. 3 shows the leading positioning part (4).
Figure 4:
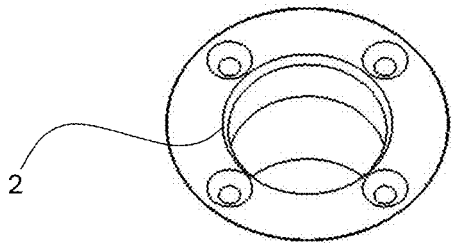
FIG. 4 shows the corresponding positioning part (2).
Figure 5:
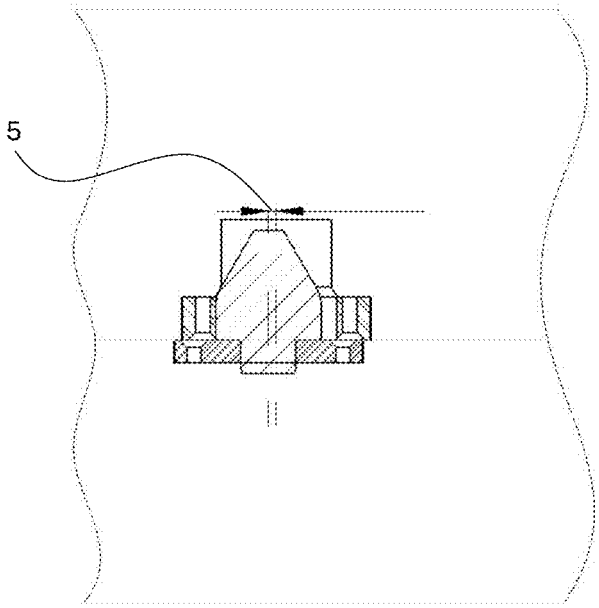
FIG. 5 shows the maximum misalignment error of the leading and corresponding positioning parts considering clearance gaps (Δ) (5).
Figure 6:
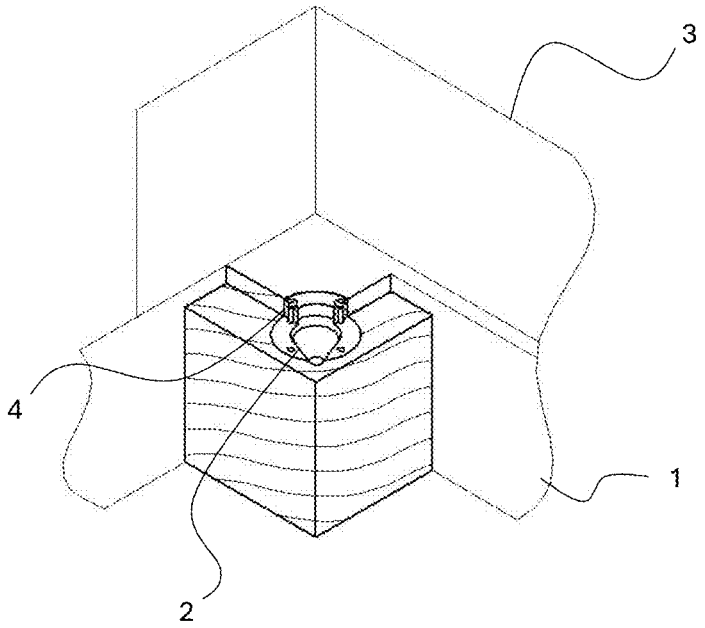
FIG. 6 shows the building element (3) that was lowered onto the foundation (1) and the leading positioning parts (4) met the foundation corresponding parts (2).

Using the claimed invention facilitates bringing building elements into their design positions. When employing the invention, there is no need to apply additional horizontal force to move the building element into its design position, and there is no need to do this manually.

As a result of using the described method, the accuracy of positioning the building element is increased, since the elements are set into design position through self-leveling and elastic deformation; labor costs are reduced because there is no need for manual adjustment of the elements' positions, which reduces time and effort for installation and allows for automation of the process; construction efficiency is enhanced, as simplifying the installation process accelerates the overall pace of construction and reduces the likelihood of errors.

The described method is applicable to elements of various masses and sizes.

The described method can be used for both vertical building elements, such as walls, and horizontal ones, such as floor slabs.

For the purposes of the present invention, a "building element" means a single-layer or multi-layer building component, for example, a panel or a slab, which can be made of a monolithic material, such as wood, or a composite material (for example, CLT (Cross-Laminated Timber) or GLT (Glued Laminated Timber) panels).

In some embodiments, the proposed method is applied to the positioning of prefabricated building elements. Prefabricated building elements are understood to be pre-manufactured components of buildings or structures, delivered to the construction site in an almost finished form. Prefabricated building elements can include wall panels (for example, wooden, reinforced concrete, or composite) and floor structures (for example, slabs, hollow-core slabs, or composite panels).

The proposed method is based on utilizing the elastic properties of materials and the force of gravity to bring building elements into their design positions without the need for complex mechanical devices or manual adjustments.

By harnessing the force of gravity, the element can spontaneously assume its design position without complicated mechanical operations.

The elastic properties of the materials are used to compensate for minor inaccuracies in positioning and geometry of such components as: the building element (for example, a slab or a panel), and the foundation on which the building element is to be placed (for example, a frame, another building element, a column, or a floor slab).

Positioning assemblies serve as guiding elements for bringing the building element into its design position when the building element is lowered onto the foundation.

Positioning assemblies consist of a leading positioning part (the leading positioning element) and a corresponding positioning part (the corresponding positioning element).

One part of the positioning assembly is placed on the building element, while the other part is placed on the foundation.

In some embodiments, the building element is fitted with the leading positioning part, while the foundation is fitted with the corresponding positioning part.

In some embodiments, the building element is fitted with the corresponding positioning part, while the foundation is fitted with the leading positioning part.

If the material of the building element and the foundation are the same, the method works as long as the following inequality (1) is satisfied:

$$E<(\tau\times A\times L\times(S1+S2))/(\Delta\times S1\times S2)$$

where

E—Young's modulus of the building element and foundation material

τ—Shear strength of the positioner's material

A—Shear area of the positioners

L—Distance between the axes of the positioning elements

Δ—The maximum misalignment error in the leading and corresponding positioning parts, taking into account clearances S1 and S2-Cross-sectional areas of the building element material (S1) and the foundation material (S2) undergoing elastic deformation Each parameter in inequality (1) influences the outcome of the positioning process.

The Young's modulus E of the building element and foundation material determines the material's ability to resist elastic deformation under load. At high values of E, inequality (1) will not be satisfied, and the method ceases to work. This means that if the material of the building element and foundation does not deform, positioning will not occur. The lower threshold for E is determined by the application area, as the material must still be suitable for use in construction.

The shear strength t of the positioner's material characterizes the maximum allowable shear stress the positioner's material can withstand before failure. If t is insufficient, installing the building element may cause premature failure of the positioning assembly elements. Theoretically, the upper limit of strength is not restricted and is determined by the choice of material and its technological properties.

The shear area A of the positioning assembly, together with the material's shear strength, determines the limit shear force of the positioners. A small shear area combined with insufficient shear strength may lead to the failure of the positioning assembly. The upper limit of the cross-sectional area is constrained by the geometry of the building element and foundation, as well as by technological limitations.

The distance L between the axes of the positioning assemblies affects the force required to elastically stretch the building element by Δ. The greater the distance L, the lower the required force. At small L values, the force may be insufficient to produce the necessary elastic deformation of the building element, and positioning will not occur. The maximum distance L is determined by the largest permissible dimensions and mass of the building element in terms of logistical and assembly capabilities.

The total misalignment of the positioning parts in the building element and the foundation, A, determines the absolute magnitude of the building element's deformation. This characteristic is calculated as the difference between the total positional tolerance of the positioning parts and the total clearance between them. If the total clearance exceeds the positional tolerance, no deformation of the building element occurs. A large total misalignment leads to greater deformation of the building element and, consequently, is limited by the maximum elongation of the building element before failure and by the ultimate strength of the positioning assembly parts, which bear the force of this deformation.

The cross-sectional areas of the material undergoing elastic deformation (S1 and S2) characterize the geometric parameters of the elastic deformation zone in the building element and the foundation, determining their longitudinal stiffness in conjunction with the material's elastic modulus. Larger values of these parameters increase the force required to achieve elongation by Δ. The upper limits of S1 and S2 are constrained by the strength limitations of the positioning assembly parts, while the lower limit is set by design parameters specified by the developer.

If the building element and foundation are made of different materials, both materials may undergo elastic deformation to different extents depending on the ratio of their stiffness. In such cases, the method works if the following condition (2) is met:

$$E1\times E2<(\tau\times A\times L\times(E1\times S1+E2\times S2))/(\Delta\times S1\times S2)$$

where

E1—Young's modulus of the building element's material

S1—Cross-sectional area of the building element's material

E2—Young's modulus of the foundation's material

S2—Cross-sectional area of the foundation's material

τ—Shear strength of the positioner's material

A—Shear area of the positioners

L—Distance between the axes of the positioning assemblies

Δ—The maximum misalignment error of the leading and corresponding positioning parts, taking into account clearances The method is effective with a wide variety of materials and across a broad range of material properties.

In some embodiments, the building element, for example a slab, is selected such that its design allows it to maintain an elastic deformation range of approximately 5000 to 20000 MPa.

In some embodiments, the foundation, i.e., the part on which the building element is to be placed, is selected so that its design allows it to maintain an elastic deformation range of approximately 5000 to 20000 MPa.

In some embodiments, the leading and corresponding positioning parts have a surface hardness in the range of 45-50 HRC (Rockwell Hardness C scale).

In some embodiments, the leading and corresponding positioning parts have a shear strength of at least 300 MPa.

In some embodiments, the taper angle of the leading positioning part is within the range of 20-30°.

A preferred embodiment of the claimed invention is described below.

The building element, for example a slab, is selected such that its design allows it to practically maintain an elastic deformation range of 5000 to 20000 MPa.

The foundation, which is the part on which the building element is to be placed, is selected so that its design allows it to practically maintain an elastic deformation range of 5000 to 20000 MPa. The foundation may be another building element, a column, or a floor slab, for example.

These parameters make it possible to achieve the desired result because the stiffness of the slab ensures the displacement of the positioning assemblies, made of a material with a hardness of 45-50 HRC, within the slab due to its elastic deformation. Thus, self-leveling of the structure occurs when the building element is installed.

The building element is lifted and held aloft by a crane or lifting mechanism so that it does not exert pressure on the foundation. The building element is then rotated and moved into a position as close as possible to the design location, but without precise installation.

Leading positioning parts (for example, conical elements) are installed on the lower part of the building element, and corresponding positioning elements (for example, conical recesses) are installed into the foundation where the building element is to be installed.

Leading positioning parts have a conical shape with a taper angle in the range of 20-30°. Conical positioning elements with a taper angle in this range facilitate directed movement of the element into the design position under the influence of gravity.

As the building element approaches the foundation, the leading positioning parts come into contact with the corresponding elements, providing a rough alignment.

After rough positioning, the building element is gradually lowered, allowing it to bear its own weight again. Under the force of gravity, the building element begins to exert pressure on the foundation through the positioning assemblies.

Due to the conical shape of the leading positioning parts and the elastic properties of the materials, the element spontaneously corrects its position, assuming the correct design location.

Described below is an example of implementing the claimed method, in which the method was used to position two first-floor slabs on the side and central beams of a two-story structure.

In this example, the building element was a floor slab made of a rectangular CLT plate 200 mm thick, measuring 5800×2900 mm, with a Young's modulus of 12,000 MPa.

In this example, the foundation was a beam made of GLT (Glued Laminated Timber) with a cross-section of 480×240 mm, a length of 2900 mm, and a Young's modulus of 11,500 MPa.

Each building element was placed so that it rested on half of the central beam on one side and on the edge beam on the other side.

The positioning assemblies were made of C60 steel. The leading positioning part was 30 mm in height with a base diameter of 48 mm, having a minimum shear strength of 360 MPa and a hardness of 50 HRC (Rockwell Hardness C). It was conical in shape with a taper angle of 30°. The corresponding positioning element was made in the form of a cylindrical cup with a diameter of 48 mm with a chamfer of 4 mm and an angle of 30° at the entrance, a depth of 61 mm, with a minimum shear strength of 360 MPa and a hardness of 50 HRC.

For each building element, four positioning assemblies were used and placed symmetrically relative to each other. The leading positioning parts were installed on the side and central beams so that their arrangement formed a rectangle, with diagonals passing through the center of the building element's design position. The distance between the pairs of leading positioning elements for each floor slab was 2180 mm.

The corresponding positioning elements were installed within the four corners of the building element, at a small distance from its edges. Their arrangement formed a rectangle with diagonals passing through the center of the building element. This configuration allows for an even distribution of load.

The positioning parts can be fixed by any known method that ensures their immobility, for example, by using screws.

The building elements were lifted one by one using a crane and lowered so that the conical positioners engaged with the corresponding positioning parts.

As the building element was lowered further, under its own weight, elastic deformation of the materials occurred, resulting in self-alignment of the building element into its design position.

After the building element was fully lowered, no additional leveling or positioning actions were required.

The invention claimed is:

1. A method for positioning building elements, comprising the following steps:

lifting the building element, moving the building element in a suspended state to a position as close as possible to the design position, lowering the building element onto a foundation, wherein leading positioning parts are arranged on the lower part of the building element, wherein corresponding positioning parts are installed into the upper surface of the foundation, wherein the building element is lowered onto the foundation until the building element leading positioning parts come into contact with the foundation corresponding parts, after which the building element is allowed to bear its own weight again, wherein the Young's modulus of the building element material (E1), the cross-sectional area of the building element (S1), the Young's modulus of the foundation material (E2), the cross-sectional area of the foundation (S2), the shear strength of the materials of the leading and corresponding positioning parts (τ), the shear area of the leading and corresponding positioning parts (A), the center-to-center distance between individual leading positioning parts or corresponding positioning parts (L), and the maximum misalignment error in the leading and corresponding positioning parts, taking into account clearance gaps between the leading and corresponding positioning parts (Δ), are selected so that the following inequality is satisfied:

$$E1 \times E2 < (\tau \times A \times L \times (E1 \times S1 + E2 \times S2)/(\Delta \times S1 \times S2).$$

2. The method of claim 1, wherein the surface hardness of the leading positioning parts and corresponding positioning parts is in the range of 45-50 HRC.

3. The method of claim 1, wherein the shear strength of the leading positioning parts and corresponding positioning parts is at least 300 MPa.

4. The method of claim 1, wherein the leading positioning part is conical in shape and the taper angle of the leading positioning part is in the range of 20-30°.

* * * * *